US009201349B2

(12) United States Patent
Shimizu et al.

(10) Patent No.: US 9,201,349 B2
(45) Date of Patent: Dec. 1, 2015

(54) DEVELOPING DEVICE, IMAGE FORMING APPARATUS

(71) Applicant: KYOCERA Document Solutions Inc., Osaka-shi, Osaka (JP)

(72) Inventors: Tamotsu Shimizu, Osaka (JP); Shizuka Okada, Osaka (JP); Yuji Kamiyama, Osaka (JP); Sakae Saito, Osaka (JP); Yasuhiro Oishi, Osaka (JP); Masashi Fujishima, Osaka (JP); Chikara Ishihara, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/570,989

(22) Filed: Dec. 15, 2014

(65) Prior Publication Data

US 2015/0177652 A1 Jun. 25, 2015

(30) Foreign Application Priority Data

Dec. 20, 2013 (JP) ..... 2013-264424

(51) Int. Cl.
*G03G 15/09* (2006.01)
*G03G 15/08* (2006.01)

(52) U.S. Cl.
CPC ..... *G03G 15/0921* (2013.01); *G03G 15/0928* (2013.01); *G03G 15/0818* (2013.01); *G03G 2215/0132* (2013.01)

(58) Field of Classification Search
CPC ..... G03G 15/09; G03G 15/0907; G03G 15/2042; G03G 21/0047; G03G 15/0815; G03G 15/0812; G03G 15/0921; G03G 15/095; G03G 15/2053; G03G 15/0241; G03G 15/065; G03G 15/0853; G03G 15/0855; G03G 15/08
See application file for complete search history.

(56) References Cited

U.S. PATENT DOCUMENTS

2003/0216234 A1* 11/2003 Sirejacob ..... 492/56
2008/0232862 A1* 9/2008 Fujishima et al. ..... 399/285
2008/0317514 A1 12/2008 Fujishima

FOREIGN PATENT DOCUMENTS

JP 2008122952 A 5/2008
JP 2009251272 A 10/2009

* cited by examiner

*Primary Examiner* — Roy Y Yi
(74) *Attorney, Agent, or Firm* — Alleman Hall McCoy Russell & Tuttle LLP

(57) ABSTRACT

Developing device includes developing roller and magnetic roller. Developing roller includes aluminum oxide thin film and resin coat layer. Magnetic roller is disposed to face, without contact, outer circumferential surface of developing roller, and includes aluminum oxide thin film formed on outer circumferential surface of base body that is made of metal including aluminum. Magnetic roller forms toner layer on surface of developing roller via magnetic brush composed of toner and magnetic carrier. AC impedance Z1 is in range from $1.0\times10^5\Omega$ to $1.0\times10^6\Omega$ and surface roughness Ra of resin coat layer is in range from 0.057 μm to 0.280 μm, AC impedance Z1 being obtained when AC voltage at predetermined frequency is applied to between base body of magnetic roller and base body of developing roller in a state where the magnetic brush is formed on magnetic roller.

4 Claims, 9 Drawing Sheets

| | |
|---|---|
| PRINT SPEED | 30 sheets/min |
| CIRCUMFERENTIAL SPEED OF PHOTOCONDUCTOR DRUM | 180 mm/s |
| CONFIGURATION OF DEVELOPING ROLLER | ALUMITE LAYER: 10 μm, RESIN COAT LAYER: 2–9 μm |
| CIRCUMFERENTIAL SPEED OF DEVELOPING ROLLER | 1.5 TIMES CIRCUMFERENTIAL SPEED OF PHOTOCONDUCTOR DRUM |
| CIRCUMFERENTIAL SPEED OF MAGNETIC ROLLER | 1.1 TIMES CIRCUMFERENTIAL SPEED OF DEVELOPING ROLLER |
| GAP BETWEEN PHOTOCONDUCTOR DRUM AND DEVELOPING ROLLER | 0.12 mm |
| GAP BETWEEN DEVELOPING ROLLER AND MAGNETIC ROLLER | 0.3 mm |
| POTENTIAL OF PHOTOCONDUCTOR DRUM | NON-IMAGE FORMING PART: +430 V, IMAGE FORMING PART: +100 V |
| BIAS VOLTAGE OF DEVELOPING ROLLER | FREQUENCY: 3.7 kHz, DUTY RATIO: 27%, Vpp: 1500 V, Vdc: 190 V |
| BIAS VOLTAGE OF MAGNETIC ROLLER | FREQUENCY: 3.7 kHz, DUTY RATIO: 73%, Vpp: 650 V, Vdc: 490 V |
| TONER DIAMETER | 6.8 μm (POSITIVE CHARGE TYPE) |

FIG. 5

| | AC IMPEDANCE Z1 (Ω) | RESIN COAT LAYER | | | | CLEANABILITY | DEVELOP ABILITY |
|---|---|---|---|---|---|---|---|
| | | TYPE | TITANIUM OXIDE (PTS.WT.) | CARBON BLACK (PTS.WT.) | SURFACE ROUGHNESS Ra (μm) | | |
| CF1 | 3.2E+04 | URETHANE COAT | 100(ET300W) | 6 | 0.320 | × | ○ |
| CF2 | 2.1E+05 | NYLON COAT | 100(ET300W) | — | 0.048 | × | ○ |
| CF3 | 1.1E+06 | NYLON COAT | 100(ET300W) | — | 0.232 | ○ | × |
| CF4 | 7.2E+04 | NYLON COAT | 150(ET300W) | — | 0.202 | × | ○ |
| CF5 | 1.5E+05 | URETHANE COAT | 100(ET300W) | 6 | 0.345 | × | ○ |
| EX1 | 1.4E+05 | NYLON COAT | 50(ET300W) | — | 0.205 | ○ | ○ |
| EX2 | 1.4E+05 | NYLON COAT | 100(ET300W) | — | 0.142 | ○ | ○ |
| EX3 | 9.3E+05 | NYLON COAT | 100(ET300W) | — | 0.188 | ○ | ○ |
| EX4 | 9.7E+05 | NYLON COAT | 125(ET300W) | — | 0.280 | ○ | ○ |
| EX5 | 1.1E+05 | NYLON COAT | 100(ET300W) | — | 0.057 | △ | ○ |

FIG. 6

| NUMBER | RATIO TO Z1 | | OCCURRENCE OF LEAK |
|---|---|---|---|
| | Z2 | Z3 | |
| EXPERIMENT 2-1 | 0.2 | 0.33 | × |
| EXPERIMENT 2-2 | 0.27 | 0.37 | ○ |
| EXPERIMENT 2-3 | 0.38 | 0.35 | ○ |
| EXPERIMENT 2-4 | 0.45 | 0.33 | × |
| EXPERIMENT 2-5 | 0.3 | 0.2 | × |
| EXPERIMENT 2-6 | 0.32 | 0.27 | ○ |
| EXPERIMENT 2-7 | 0.36 | 0.38 | ○ |
| EXPERIMENT 2-8 | 0.31 | 0.45 | × |

FIG. 9

| | |
|---|---|
| PRINT SPEED | 30 sheets/min |
| CIRCUMFERENTIAL SPEED OF PHOTOCONDUCTOR DRUM | 180 mm/s |
| CONFIGURATION OF DEVELOPING ROLLER | ALUMITE LAYER: 10 μm, RESIN COAT LAYER: 2–9 μm |
| CIRCUMFERENTIAL SPEED OF DEVELOPING ROLLER | 1.5 TIMES CIRCUMFERENTIAL SPEED OF PHOTOCONDUCTOR DRUM |
| CIRCUMFERENTIAL SPEED OF MAGNETIC ROLLER | 1.1 TIMES CIRCUMFERENTIAL SPEED OF DEVELOPING ROLLER |
| GAP BETWEEN PHOTOCONDUCTOR DRUM AND DEVELOPING ROLLER | 0.12 mm |
| GAP BETWEEN DEVELOPING ROLLER AND MAGNETIC ROLLER | 0.3 mm |
| POTENTIAL OF PHOTOCONDUCTOR DRUM | NON-IMAGE FORMING PART: +430 V, IMAGE FORMING PART: +100 V |
| BIAS VOLTAGE OF DEVELOPING ROLLER | FREQUENCY: 3.7 kHz, DUTY RATIO: 27%, Vpp: 1500 V, Vdc: 190 V |
| BIAS VOLTAGE OF MAGNETIC ROLLER | FREQUENCY: 3.7 kHz, DUTY RATIO: 73%, Vpp: 650 V, Vdc: 490 V |
| TONER DIAMETER | 6.8 μm (POSITIVE CHARGE TYPE) |

DEVELOPING DEVICE, IMAGE FORMING APPARATUS

INCORPORATION BY REFERENCE

This application is based upon and claims the benefit of priority from the corresponding Japanese Patent Application No. 2013-264424 filed on Dec. 20, 2013, the entire contents of which are incorporated herein by reference.

BACKGROUND

The present disclosure relates to a developing device including a developing roller that is disposed to face, without contact, the outer circumferential surface of the image carrier, and to an image forming apparatus.

A developing device is installed in an image forming apparatus which is a copier, a printer or the like and forms an image on a paper sheet based on the electrophotography. The developing device develops, by toner, an electrostatic latent image formed on an image carrier such as a photoconductor drum. As the developing method, a so-called two-component developing method is known which uses two-component developer including magnetic carrier and toner to develop a toner image on the image carrier. As an example of the two-component developing method, there is conventionally known a contactless developing system called "interactive touchdown developing system". In the interactive touchdown developing system, a developing roller and a magnetic roller are used. The developing roller is disposed at a predetermined distance from the image carrier. A magnet is embedded in the magnetic roller. The magnetic roller draws up the magnetic carrier as well as the toner, and holds them on the surface thereof. The magnetic roller forms a magnetic brush thereon to transfer only the toner to the developing roller, and form a toner thin layer on the developing roller. An AC electric field is generated by a developing bias including an AC component applied to the developing roller, and the AC electric field flies the toner from the developing roller and causes the toner to adhere to the electrostatic latent image on the image carrier.

SUMMARY

A developing device according to an aspect of the present disclosure includes a developing roller and a magnetic roller. The developing roller is disposed to face, without contact, an outer circumferential surface of an image carrier, and includes an aluminum oxide thin film and a resin coat layer, the aluminum oxide thin film being formed on an outer circumferential surface of a base body that is made of a metal including aluminum, the resin coat layer being formed on a surface of the aluminum oxide thin film, the resin coat layer being made of a resin material having electric conductivity. The magnetic roller is disposed to face, without contact, an outer circumferential surface of the developing roller, and includes an aluminum oxide thin film formed on an outer circumferential surface of a base body that is made of a metal including aluminum. The magnetic roller forms a toner layer on a surface of the developing roller via a magnetic brush composed of toner and magnetic carrier. An AC impedance Z1 is in a range from $1.0\times10^5\Omega$ to $1.0\times10^6\Omega$ and a surface roughness Ra of the resin coat layer is in a range from 0.057 μm to 0.280 μm, the AC impedance Z1 being obtained when an AC voltage at a predetermined frequency is applied to between the base body of the magnetic roller and the base body of the developing roller in a state where the magnetic brush is formed on the magnetic roller.

An image forming apparatus according to another aspect of the present disclosure includes the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5 is a table showing comparative examples 1 to 5 (CF1-5) and examples 1 to 5 (EX1-5) pertaining to the AC impedance Z1 and the surface roughness Ra of the developing sleeve.

FIG. 6 is a diagram showing measurement values of the ratios of the AC impedances Z2 and Z3 to the AC impedance Z1 in the example 1.

FIG. 9 is a diagram showing the conditions for the respective components of the image forming apparatus 10 and the developing device 41.

DETAILED DESCRIPTION

The following describes embodiments of the present disclosure with reference to the drawings as appropriate. It should be noted that the following embodiments are only examples of specific embodiments of the present disclosure and can be varied as appropriate without changing the gist of the present disclosure.

Figure 1:
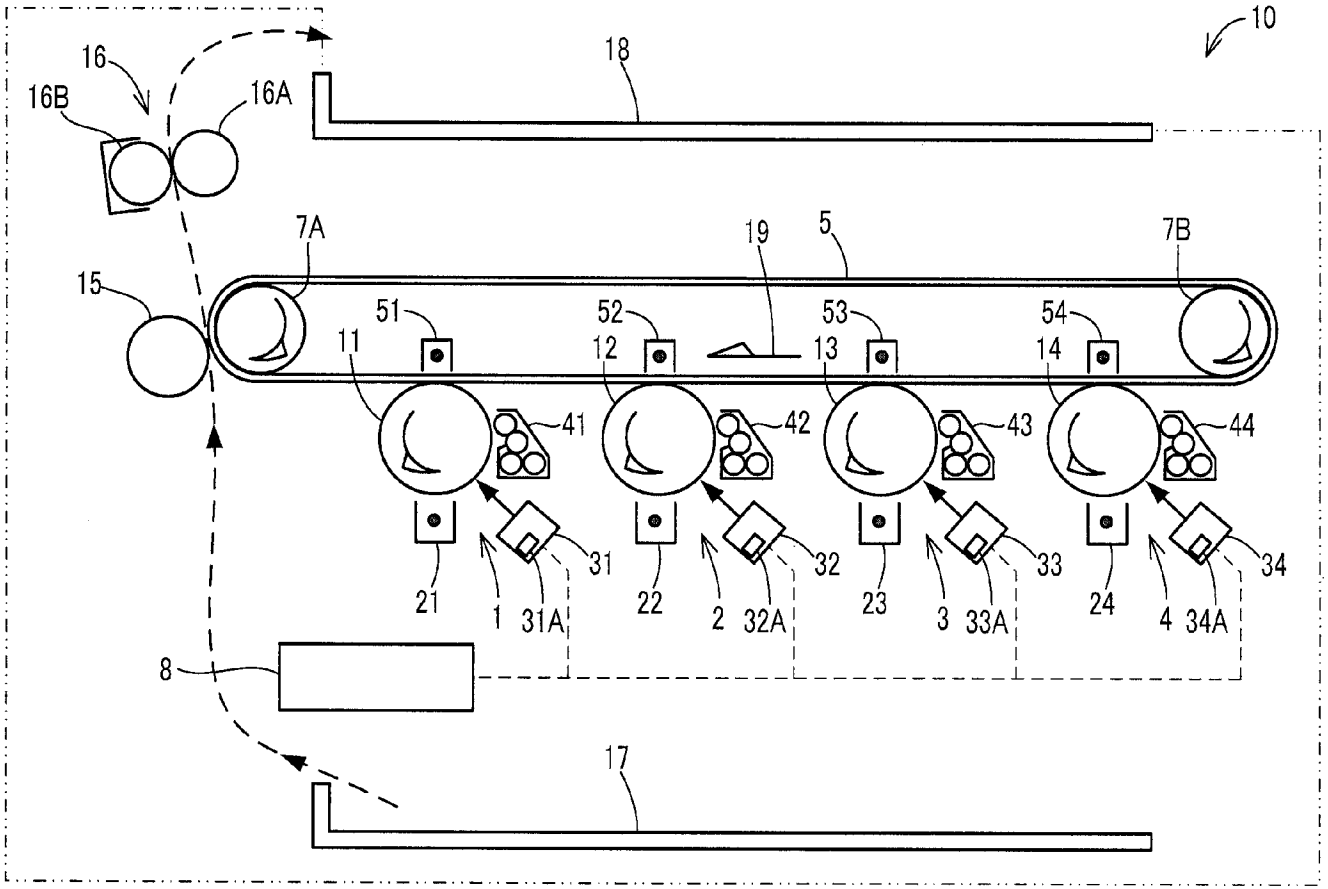
FIG. 1 is a schematic diagram showing the configuration of the image forming apparatus in an embodiment of the present disclosure.

FIG. 1 is a schematic diagram showing an outlined configuration of an image forming apparatus 10 (an example of the image forming apparatus of the present disclosure) in an embodiment of the present disclosure. As shown in FIG. 1, the image forming apparatus 10 is a so-called tandem color image forming apparatus, and includes a plurality of image forming portions 1-4, an intermediate transfer belt 5, a driving roller 7A, a driven roller 7B, a secondary transfer device 15, a fixing device 16, a control portion 8, a sheet feed tray 17, and a sheet discharge tray 18. It is noted that specific examples of the image forming apparatus 10 in an embodiment of the present disclosure are a copier, a facsimile, a printer that can form a color image or a monochrome image, and a multifunction peripheral having these functions.

The image forming portions 1-4 form images based on the electrophotography. The image forming portions 1-4 form toner images of different colors respectively on a plurality of photoconductor drums 11-14 arranged in an alignment (an example of the image carrier of the present disclosure), and transfer the toner images onto the intermediate transfer belt 5 in sequence while the intermediate transfer belt 5 is running (moving) so that the images are overlaid with each other. In an example shown in FIG. 1, in order from the downstream side in the movement direction (the direction indicated by arrow 19) of the intermediate transfer belt 5, an image forming portion 1 for black, an image forming portion 2 for yellow, an image forming portion 3 for cyan, and an image forming portion 4 for magenta are arranged in a row in the stated order.

The image forming portions 1-4 include the photoconductor drums 11-14, charging devices 21-24, exposure devices 31-34, developing devices 41-44 (an example of the developing device of the present disclosure), first transfer devices 51-54 and the like, respectively. The photoconductor drums 11-14 carry toner images on the surfaces thereof. The charging devices 21-24 charge the surfaces of the corresponding photoconductor drums 11-14 to a predetermined potential. The exposure devices 31-34 write electrostatic latent images on the charged surfaces of the photoconductor drums 11-14 by exposing the surfaces to light that is scanned thereon. The developing devices 41-44 develop the electrostatic latent images on the photoconductor drums 11-14 by toner. The first transfer devices 51-54 transfer the toner images from the rotating photoconductor drums 11-14 onto the intermediate transfer belt 5. It is noted that although not shown in FIG. 1, the image forming apparatuses 1-4 also include cleaning devices for removing remaining toner from the surfaces of the photoconductor drums 11-14.

The intermediate transfer belt 5 is, for example, a belt having a shape of an endless loop and is made of rubber, urethane or the like. The intermediate transfer belt 5 is supported by the driving roller 7A and the driven roller 7B so as to be driven and rotated. The driving roller 7A is located close to the fixing device 16 (on the left side in FIG. 1), and the driven roller 7B is located away from the fixing device 16 (on the right side in FIG. 1). The surface of the driving roller 7A is made of, for example, a material such as rubber, urethane or the like that increases friction force with the intermediate transfer belt 5. Being supported by the driving roller 7A and the driven roller 7B, the intermediate transfer belt 5 moves (runs), with its surface contacting with the surfaces of the photoconductor drums 11-14. When the intermediate transfer belt 5 passes between the photoconductor drums 11-14 and the first transfer devices 51-54, the toner images are transferred in sequence from the photoconductor drums 11-14 onto the surface of the intermediate transfer belt 5 so that the images are overlaid with each other.

The second transfer device 15 transfers the toner image from the intermediate transfer belt 5 to a print sheet conveyed from the paper feed tray 17. The print sheet with the transferred toner image thereon is conveyed to the fixing device 16 by a conveyance device (not shown). The fixing device 16 includes a heating roller 16A heated to a high temperature and a pressure roller 16B. The pressure roller 16B is disposed to face the heating roller 16A. The print sheet conveyed to the fixing device 16 is conveyed while being nipped by the heating roller 16A and the pressure roller 16B. This allows the toner image to be fused and fixed to the print sheet. The print sheet is then ejected onto the ejected paper tray 18.

As described above, the image forming apparatus 10 forms a color toner image on the surface of the intermediate transfer belt 5 by causing the plurality of image forming portions 1-4 to transfer toner images of different colors onto the intermediate transfer belt 5 while the belt is running so that the toner images are overlaid with each other. Furthermore, the image forming apparatus 10 forms a color image on a print sheet by causing the second transfer device 15 to transfer the toner image from the intermediate transfer belt 5 to the print sheet. Note that, as another embodiment, the intermediate transfer belt 5 may be used as a conveyance belt, and the toner images may be overlaid with each other directly on a print sheet while the paper sheet is conveyed by the conveyance belt. Also, as a still another embodiment, an intermediate transfer member shaped like a roller may be used in place of the intermediate transfer belt 5.

The control portion 8 comprehensively controls the image forming apparatus 10. The control portion 8 includes a CPU, a ROM, a RAM, an EEPROM, a motor driver, and the like. The RAM is a volatile storage medium, and the EEPROM is a nonvolatile storage medium. The RAM and the EEPROM are used as temporary storage memories for the various types of processes executed by the CPU. The motor driver drives and controls various types of motors (not shown) based on control signals received from the CPU.

Figure 2:
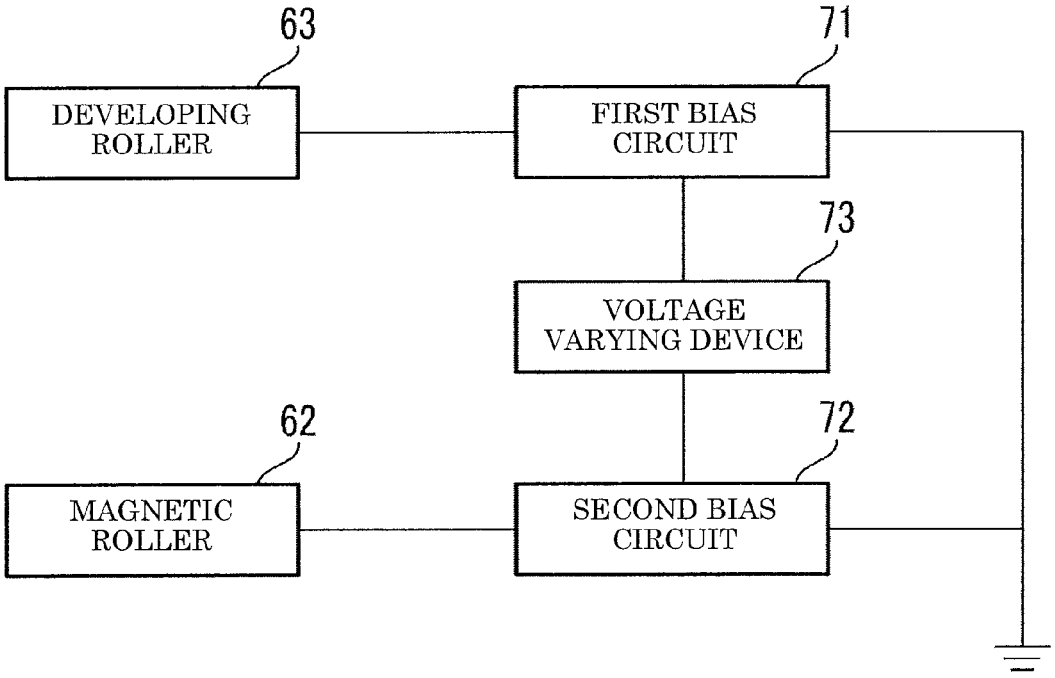
FIG. 2 is a block diagram showing the configuration of the control portion included in the image forming apparatus of FIG. 1.

As shown in FIG. 2, the control portion 8 includes a first bias circuit 71, a second bias circuit 72, and a voltage varying device 73. The first bias circuit 71 applies a voltage to a developing roller 63 which is included in each of the developing devices 41-44 (see FIG. 3). The second bias circuit 72 applies a voltage to a magnetic roller 62 which is included in each of the developing devices 41-44 (see FIG. 3). The voltage varying device 73 varies the voltages applied to the developing roller 63 and the magnetic roller 62.

Figure 3:
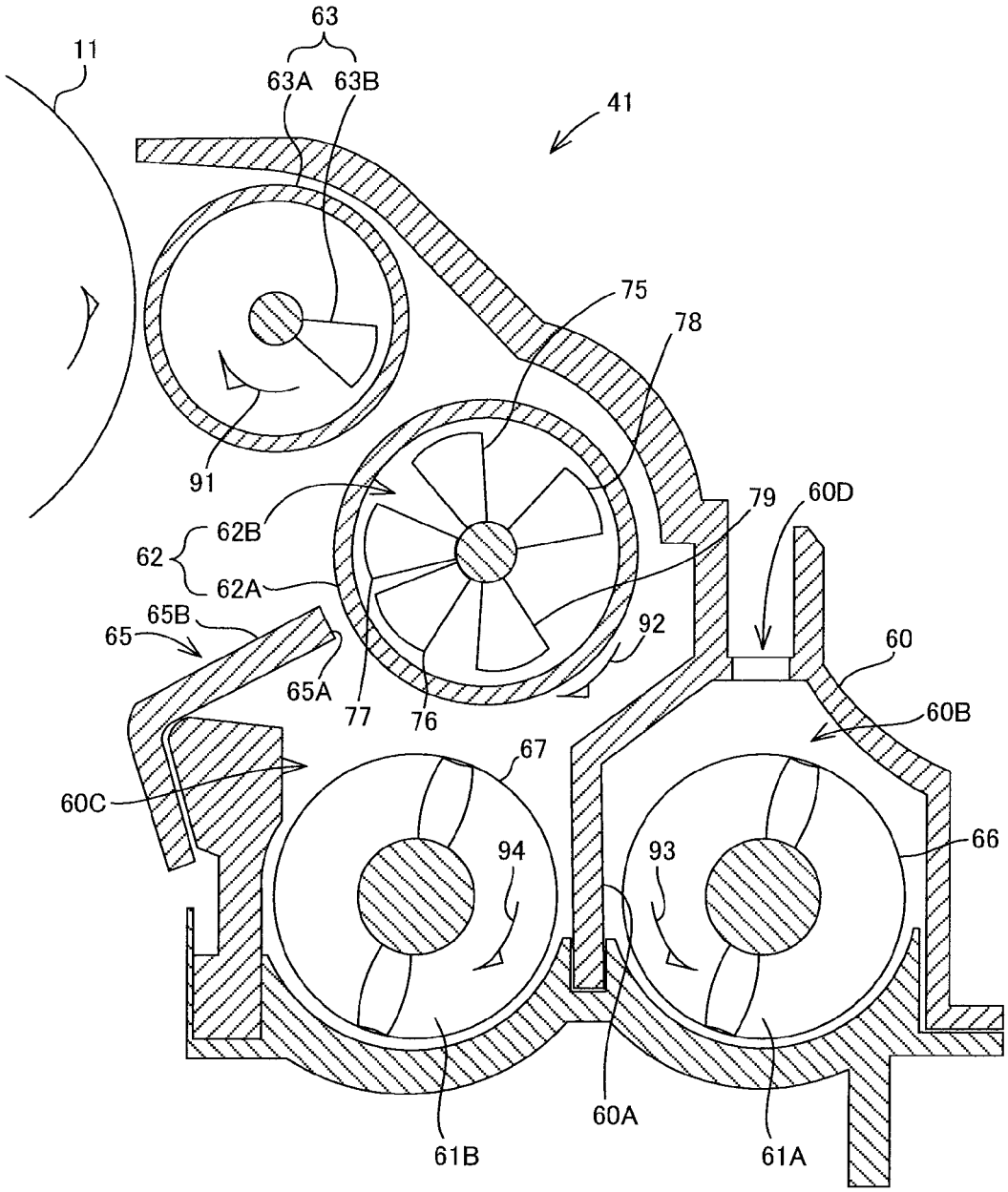
FIG. 3 is a cross sectional view showing the configuration of the developing device in an embodiment of the present disclosure.

FIG. 3 is a cross-sectional diagram showing the configuration of the developing device 41 included in the image forming portion 1. The configuration of the developing device 41 is explained in the following with reference to FIG. 3. It is noted that the other developing devices 42-44 have the same configuration as the developing device 41, and detailed description thereof is omitted.

The developing device 41 develops images by a developing system called "interactive touchdown developing system" which causes toner to be adhered to the electrostatic latent image while the developing device is not contacting the photoconductor drum 11. As shown in FIG. 3, the developing device 41 includes a developer case 60 in which two-component developer (hereinafter also referred to merely as "developer") including toner and magnetic carrier is stored. The developer container 60 is partitioned into a first stirring chamber 60B and a second stirring chamber 60C by a partition wall 60A. The developer is stored in both the first stirring chamber 60B and the second stirring chamber 60C. In the first stirring chamber 60B and the second stirring chamber 60C, the first stirring screw 61A and the second stirring screw 61B are rotatably provided, respectively. The toner is supplied from a toner container (not shown) to the developer case 60, and the first stirring screw 61A and the second stirring screw 61B mix the toner with magnetic carrier and stir them to charge the toner.

The magnetic roller 62 and the developing roller 63 are provided in the developer container 60. The magnetic roller 62 holds, on its roller surface, the toner and the magnetic carrier. The magnetic roller 62 forms a toner layer on the surface of the developing roller 63 via a magnetic brush, which, as described below, is composed of the magnetic carrier adhered with the toner. The developing roller 63 is disposed to face the magnetic roller 62. Specifically, the magnetic roller 62 is disposed above the second stirring screw 61B. The developing roller 63 is disposed at the upper left of the magnetic roller 62 to face the magnetic roller 62 with a predetermined gap therebetween. In addition, the developing roller 63 faces the photoconductor drum 11 at an opening 64 of the developer container 60 (at left in FIG. 3) with a predetermined gap therebetween. That is, the developing roller 63 is disposed to face the outer circumferential surface of the photoconductor drum 11. The magnetic roller 62 and the developing roller 63 are both rotated clockwise in FIG. 3 (see arrows 91, 92).

The magnetic roller 62 includes a non-magnetic rotating sleeve 62A and a magnetic-roller-side magnetic pole 62B that includes a plurality of magnetic poles. The rotating sleeve 62A is rotatably supported by a frame (not shown) of the developing device 41.

Figure 4B:
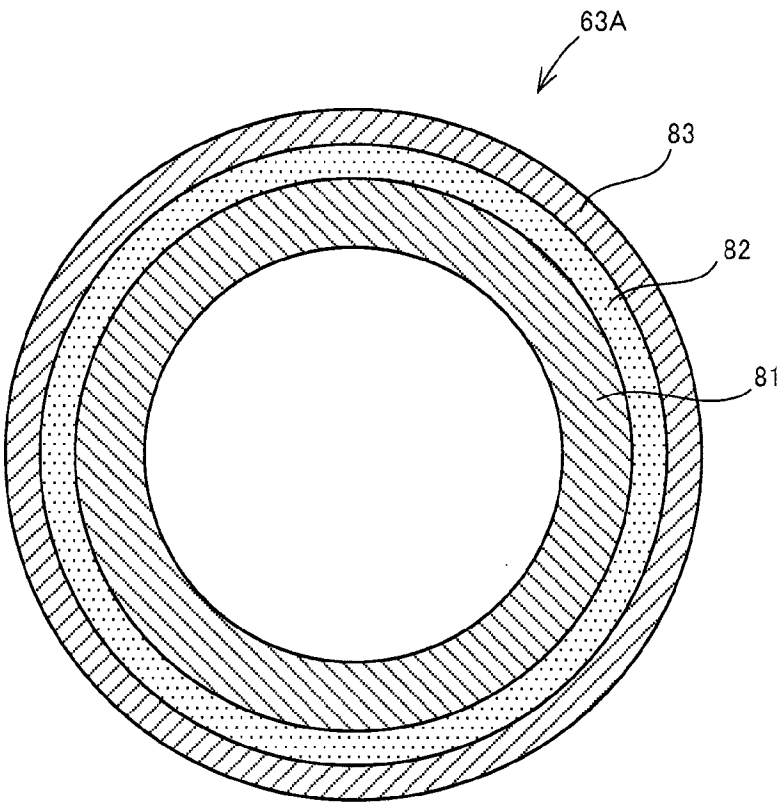
FIGS. 4A and 4B are cross sectional views showing the configurations of the rotating sleeve of the magnetic roller and the developing sleeve of the developing roller included in the developing device.
Figure 4A:
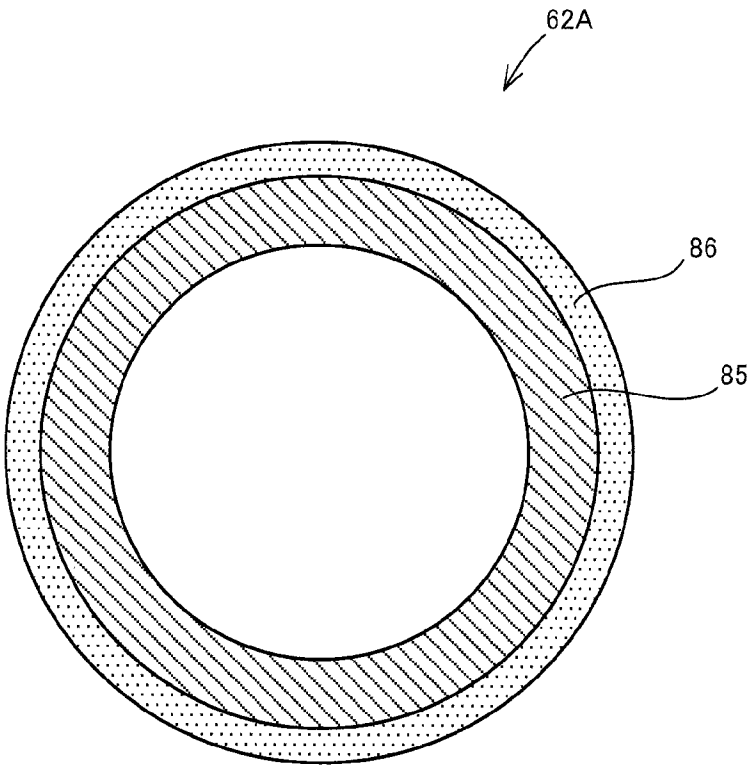

As shown in FIG. 4A, the rotating sleeve 62A includes a cylindrical base body 85 which is a raw pipe made of aluminum, and the outer circumferential surface of the base body 85 is coated with an alumite layer 86. The alumite layer 86 is coated by the alumite treatment. The alumite treatment is also referred to as "anodic oxidation processing". In this treatment, the base body 85 of aluminum, as an electrode, is dipped into an electrolytic tank containing acidic aqueous solution of sulfuric acid or the like as the electrolytic bath (treatment bath). The electrolytic bath is electrolyzed by DC or AC, thereby an aluminum oxide coating is formed on the surface of the base body 85. With this alumite treatment, it is possible to form an aluminum oxide coating having a thickness of 5 to 100 μm on the surface of the base body 85. In the present embodiment, the base body 85 made of aluminum and being 12 to 20 mm in outer diameter is subjected to the coating treatment (alumite treatment) to be coated with the alumite layer 86 that is 10 μm in thickness, wherein 10 μm is the maximum thickness with which cracks are difficult to occur. For example, sulfuric acid alumite, oxalic acid alumite, alumite that is obtained by using mixed organic acids and setting the electrolyte temperature to the normal temperature, or the like is applicable as the alumite layer 86. It is noted that the alumite layer 86 plays a role in electrically insulating the magnetic roller 62 from the developing roller 63, and by adjusting the layer thickness of the alumite layer 86, a proper and stable insulation is maintained in the alumite layer 86 and a leak is suppressed from occuring.

The magnetic-roller-side magnetic pole 62B is contained in the rotating sleeve 62A. That is, the magnetic-roller-side magnetic pole 62B is provided inside the rotating sleeve 62A. The magnetic-roller-side magnetic pole 62B is fixed inside the rotating sleeve 62A. In the present embodiment, the magnetic-roller-side magnetic pole 62B has five magnetic poles: a main pole 75; a regulation pole (a brush-clipping magnetic pole) 76; a carrying pole 77; a peeling pole 78; and a draw-up pole 79. The magnetic poles 75-79 may be, for example, permanent magnets or electromagnets that generate magnetic forces.

The main pole 75 is attached to the magnetic-roller-side magnetic pole 62B in the state where the magnetic pole face of the main pole 75 faces the developing roller 63. The main pole 75 forms a magnetic field with a developing-roller-side magnetic pole 63B provided in the developing roller 63, wherein in the magnetic field, they pull each other.

The developer container 60 is provided with a brush-clipping blade 65. The brush-clipping blade 65 extends along a longitudinal direction of the magnetic roller 62 (namely in the direction perpendicular to the plane of FIG. 3). The brush-clipping blade 65 is disposed on the upstream side of a position at which the developing roller 63 faces the magnetic roller 62, in the rotational direction of the magnetic roller 62 (see the arrow 92). There is a small gap (a short distance) between the edge of the brush-clipping blade 65 and the roller surface of the magnetic roller 62.

The regulation pole 76 is attached to the magnetic-roller-side magnetic pole 62B in the state where the magnetic pole face of the regulation pole 76 faces the brush-clipping blade 65. That is, the regulation pole 76 and the brush-clipping blade 65 are disposed to face each other. The brush-clipping blade 65 is made of, for example, a non-magnetic material or a magnetic material. Since the brush-clipping blade 65 faces the regulation pole 76 of the magnetic-roller-side magnetic pole 62B, a magnetic field is generated in a gap between the top edge of the brush-clipping blade 65 and the rotating sleeve 62A, wherein in the magnetic field, the regulation pole 76 and the brush-clipping blade 65 pull each other. With the presence of this magnetic field and a voltage applied by the second bias circuit 72, the magnetic brush, which is composed of the toner and the magnetic carrier, is formed between the brush-clipping blade 65 and the rotating sleeve 62A.

The developing roller 63 includes a cylindrical developing sleeve 63A and the developing-roller-side magnetic pole 63B. The developing sleeve 63A is rotatably supported by a frame (not shown) of the developing device 41.

As shown in FIG. 4A, the developing sleeve 63A includes a cylindrical base body 81 which is a raw pipe made of aluminum, and the outer circumferential surface of the base body 81 is coated with an alumite layer 82. The alumite layer 82 is coated by the above-explained alumite treatment. With this alumite treatment, it is possible to form an aluminum oxide coating having a thickness of 5 to 100 μm on the surface of the base body 81. For example, sulfuric acid alumite, oxalic acid alumite, alumite that is obtained by using mixed organic acids and setting the electrolyte temperature to the normal temperature, or the like is applicable as the alumite layer 82.

The surface of the alumite layer 82 is coated with a resin coat layer 83 (an example of the resin coat layer of the present disclosure) which is made of a resin material having electric conductivity. That is, in the developing sleeve 63A, the alumite layer 82 is formed on the outer circumferential surface of the base body 81, and the resin coat layer 83 is formed on the surface of the alumite layer 82. Nylon resin is used as the material of the resin coat layer 83. That is, the resin coat layer 83 is a coat layer made of nylon resin. More specifically, the resin coat layer 83 is formed from the nylon resin which contains titanium oxide in a dispersed state, wherein the titanium oxide has electric conductivity and is used as a conductive agent. The resin coat layer 83 has electric conductivity since it contains the titanium oxide.

In the present embodiment, by the coating process (alumite process), the surface of the base body 81 that is made of aluminum and is 12 mm to 20 mm in outer diameter is coated with the alumite layer 82 that is 10 μm in thickness. Subsequently, the resin coat layer 83 that is in the range from 2 μm to 9 μm in thickness is formed on the surface of the alumite layer 82 by the dipping method. Although the thickness of the alumite layer 82 can be selected as appropriate, an optimum thickness of the alumite layer 82 is 10 μm when the base body 81 is approximately 12 mm to 20 mm in diameter. The material of the resin coat layer 83 is produced by adding 50 to 125 pts. wt. of titanium oxide to 100 pts. wt. of nylon resin.

The developing sleeve 63A of the present embodiment is manufactured through the following processes. That is, the alumite layer 82 having a thickness of 10 μm is formed by allowing the outer circumferential surface of the base body 81 to be subjected to the alumite process. Subsequently, the surface of the base body 81, namely the surface of the alumite layer 82 is heated in a heating process at 120° C. This heating process is performed to cause cracks to occur in advance before a drying process of the resin coat layer 83 is performed, thereby preventing cracks from occuring in the drying process. The time period for which the heating process is performed is determined in advance, and is set to be more than a time period for which the drying process is performed. The heating process is always performed at a predetermined temperature for a predetermined time period. This allows an approximately constant amount of cracks to occur to each base body 81 that is subjected to the heating process. After the heating process, a process for forming the resin coat layer 83 is executed. Specifically, in this process, nylon resin as the binding resin, titanium oxide as the conductive agent, and 800 pts. wt. of methanol as the dispersed medium are mixed together with zirconia beads of 1.0 mm in diameter for approximately 48 hours by a ball mill. In the mixed liquid, the base body 81 made of aluminum having been subjected to the alumite process is soaked and then taken out. The base body 81 is then dried in a high-temperature environment of 130° C. for 10 minutes. This completes manufacturing of the developing sleeve 63A coated with the resin coat layer 83 whose thickness is 2 to 9 μm . As described above, according to the present embodiment, the alumite layer is allowed to generate cracks in the heating process before the resin coat layer 83 is coated. This prevents the conductive agent that is contained in the resin coat layer 83, from being distributed unevenly due to a convection that occurs inside the resin coat layer 83 during the drying process of the resin coat layer 83. As a result, it is possible to form the resin coat layer 83 evenly.

As shown in FIG. 3, the developing-roller-side magnetic pole 63B is contained in the developing sleeve 63A. That is, the developing-roller-side magnetic pole 63B is provided inside the developing sleeve 63A. The developing-roller-side magnetic pole 63B is composed of, for example, a permanent magnet that generates a magnetic force, and has a different polarity from the main pole 75. As a result, the developing-roller-side magnetic pole 63B and the main pole 75 form a magnetic field in which they pull each other.

A first bias circuit 71 (see FIG. 2), which applies a DC voltage (hereinafter referred to as "Vslv[DC]") and an AC voltage (hereinafter referred to as "Vslv[AC]"), is connected to the developing sleeve 63A of the developing roller 63. A second bias circuit 72, which applies a DC voltage (hereinafter referred to as "Vmag[DC]") and an AC voltage (hereinafter referred to as "Vmag[AC]"), is connected to the rotating sleeve 62A of the magnetic roller 62. The first bias circuit 71 and the second bias circuit 72 are grounded to the same ground. The first bias circuit 71 and the second bias circuit 72 superpose the DC voltage that is supplied from a DC power source (not shown), and the AC voltage that is supplied from an AC power source (not shown), and apply the superposed voltage. In the present embodiment, the first bias circuit 71 and the second bias circuit 72 apply voltages of opposite phases.

A voltage varying device 73 (see FIG. 2) is connected to the first bias circuit 71 and the second bias circuit 72. The voltage varying device 73 can vary the Vslv[DC] and the Vslv[AC] to be applied to the developing roller 63, and vary the Vmag [DC] and the Vmag[AC] to be applied to the magnetic roller 62.

As described above, the developer is stirred by the first stirring screw 61A and the second stirring screw 61B while being circulated in the developer container 60, wherein the toner is charged and the developer is conveyed to the magnetic roller 62 by the second stirring screw 61B. The brush-clipping blade 65 is disposed to face the regulation pole 76 of the magnetic-roller-side magnetic pole 62B. As a result, the magnetic brush is formed between the brush-clipping blade 65 and the rotating sleeve 62A. The magnetic brush on the magnetic roller 62 is regulated in layer thickness by the brush-clipping blade 65, and as the rotating sleeve 62A rotates, the magnetic brush moves to a position at which it faces the developing roller 63. At this position, a magnetic field is imparted to the magnetic brush, in which the main pole 75 of the magnetic-roller-side magnetic pole 62B and the developing-roller-side magnetic pole 63B pull each other. This causes the magnetic brush to be contacted with the roller surface of the developing roller 63. As a result, the toner having been adhered to the magnetic carrier of the magnetic brush is transferred to the developing roller 63. In addition, due to the magnetic field and a potential difference ΔV between Vmag [DC] applied to the magnetic roller 62 and Vslv[DC] applied to the developing roller 63, a toner thin layer is formed on the roller surface of the developing roller 63. It is noted that the toner thin layer on the developing roller 63 varies in thickness as the potential difference AV is adjusted by the voltage varying device 73.

As the developing roller 63 rotates, the toner thin layer formed on the developing roller 63 via the magnetic brush is conveyed to a position where the photoconductor drum 11 and the developing roller 63 face each other. Since a voltage including an AC component has been applied to the developing sleeve 63A of the developing roller 63, toner flies toward the photoconductor drum 11 due to the potential difference (developing bias) between the developing roller 63 and the photoconductor drum 11. At this time, the toner reciprocates actively between the photoconductor drum 11 and the developing sleeve 63A due to an AC electric field formed by the AC voltage applied to the developing sleeve 63A. Toner that has reached the electrostatic latent image on the photoconductor drum 11 adheres to and develops the electrostatic latent image. On the other hand, toner reciprocating between the developing sleeve 63A and a non-image area other than the electrostatic latent image is returned to the developing sleeve 63A without adhering to the non-image area.

When the rotating sleeve 62A of the magnetic roller 62 further rotates clockwise, the magnetic brush is separated from the roller surface of the developing roller 63 due to a magnetic field in a horizontal direction (a circumferential direction of the roller) that is generated by the carrying pole 77 that has a different pole and is adjacent to the main pole 75. As a result, toner that has remained without being used in the developing is collected from the developing roller 63 onto the rotating sleeve 62A. When the rotating sleeve 62A further rotates, a magnetic field is imparted, wherein in the magnetic field, the peeling pole 78 and the draw-up pole 79 of the magnetic-roller-side magnetic pole 62B, both having the same polarity, repel each other. This causes the toner to be separated from the rotating sleeve 62A in the developer container 60. The toner and the magnetic carrier are then stirred and conveyed by the second stirring screw 61B, drawn up again by the draw-up pole 79 and held on the rotating sleeve 62A as a two-component developer that has appropriate toner density and has been uniformly charged. The magnetic brush is then formed and conveyed to the brush-clipping blade 65.

Meanwhile, in the developing device 41, a carrier adhesion phenomenon may occur in which the magnetic carrier is transferred from the magnetic roller 62 together with the toner, and adheres to the developing roller 63. When the carrier adhesion phenomenon occurs, and magnetic carrier that has adhered to the developing roller 63 is further supplied to the image carrier, such as the photoconductor drum 11, the cleanability of toner on the surface of the image carrier may be deteriorated, or an image failure due to a transfer omission may occur, resulting in deterioration in image quality. The carrier adhesion phenomenon tends to occur when the developing sleeve 63A of the developing roller 63 is lower in resistance than the rotating sleeve 62A of the magnetic roller 62. In particular, the carrier adhesion phenomenon is easy to occur in a state where charges can be easily imparted from the developing roller 63 to the magnetic carrier in the magnetic brush on the rotating sleeve 62A. On the other hand, the carrier adhesion phenomenon can be suppressed by increasing the resistance of the developing roller. However, when the resistance of the developing sleeve 63A is increased, the developability to develop the electrostatic latent image with toner is decreased, and a deficiency of transferring toner from the magnetic roller 62 to the developing roller 63 occurs, resulting in an insufficient image density. This problem is prominent in a low-temperature low-humidity environment in which the amount of charged toner increases.

In view of these, the inventors have made intensive studies and found, from the results of experiments 1 and 2 that are described below, a relationship between the value of AC impedance Z1 and the value of surface roughness Ra of the developing sleeve 63A, wherein the relationship can suppress the carrier adhesion phenomenon and improve the developability, the AC impedance Z1 being obtained when a predetermined AC voltage is applied to between the developing sleeve 63A and the rotating sleeve 62A.

The AC impedance Z1 indicates an electrical resistance that is generated when a predetermined AC voltage is applied to between the base body 81 of the developing sleeve 63A and the base body 85 of the rotating sleeve 62A, and is represented by the following equation (1) in which the resistance component Rs and the electrostatic capacitance component Cs are used.

[Equation 1]

$$Z^2 = Rs^2 + \left(\frac{1}{2\pi f \cdot Cs}\right)^2 \quad (1)$$

Figure 7:
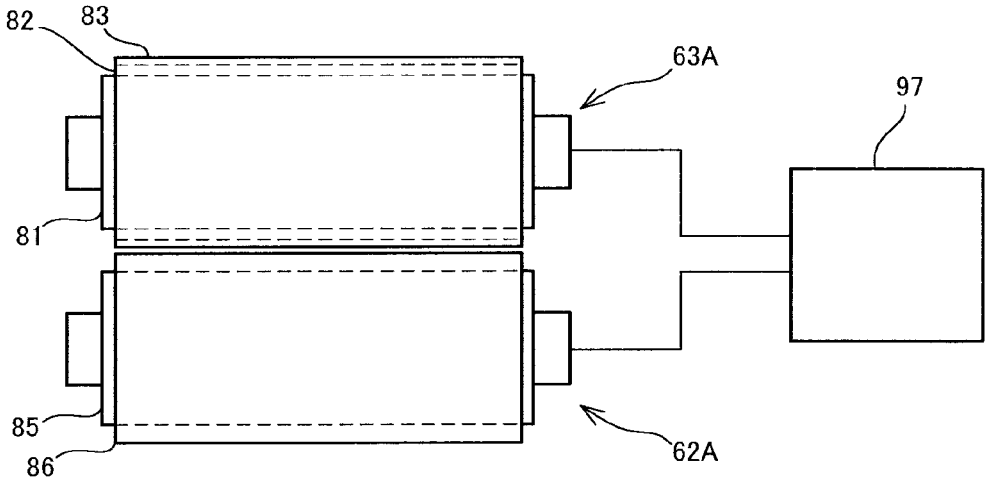
FIG. 7 is a schematic diagram for explaining the measurement method of the AC impedance Z1.

In the experiment 1, as shown in FIG. 5, comparative examples 1 to 5 and examples 1 to 5 of the developing device 41 were prepared. In the experiment 1, the AC impedance Z1 between the developing sleeve 63A and the rotating sleeve 62A was obtained for each of the comparative examples and the examples by a measuring method shown in FIG. 7. Specifically, the rotating sleeve 62A of the magnetic roller 62 provided in the developing device 41 was connected to an electrode of an impedance measuring instrument 97 (LCR HiTESTER 3522 made by Hioki E.E. Corporation), and the developing sleeve 63A of the developing roller 63 was connected to the other electrode of the impedance measuring instrument 97. In this state, the AC impedance Z1 as measured from each of the comparative examples 1 to 5 and the examples 1 to 5 shown in FIG. 5 by the impedance measuring instrument 97. In the experiment 1, an AC voltage of sine wave and 5.0 V at the frequency of 5.0 kHz was applied to the electrodes of the impedance measuring instrument 97. The measurement of the AC impedance Z1 was performed a plurality of times (twice to 16 times), and the average values of the measured values are shown in the table of FIG. 5 as the experiment results.

The conductive agent used in the comparative examples 1 and 5 for the experiment 1 was prepared by mixing carbon black with titanium oxide (ET300W made by Ishihara Sangyo Kaisha, Ltd.) having primary particle size of 30 nm. The conductive agent used in the other comparative examples and examples for the experiment 1 was only titanium oxide (ET300W made by Ishihara Sangyo Kaisha, Ltd.) having primary particle size of 30 nm. The contents of the titanium oxide and the carbon black are shown in FIG. 5. In addition, the resin coat layer of the comparative examples 1 and 5 was made of urethane resin, and the resin coat layer of the other comparative examples and examples was made of nylon resin.

The surface roughness Ra of the resin coat layer 83 of the developing sleeve 63A shown in FIG. 5 was measured using a measurement apparatus "SURFCOM5000DX" made by TOKYO SEIMITSU CO., LTD. It is noted that the conditions for the respective components of the image forming apparatus 10 and the developing device 41 in the experiment 1 are shown in FIG. 9.

Furthermore, from the results of monochrome image formation on a print sheet by using the developing device 41 in which the rotating sleeve 62A and the developing sleeve 63A of each example shown in FIG. 5 have been installed, evaluation was made on the cleanability (the occurrence of cleaning failure) and the developability. The evaluation results are shown in the table of FIG. 5. It is noted that the cleaning failure is an image failure that occurs when the magnetic carrier that is larger in diameter than the toner is not removed by the cleaning device when the magnetic carrier adheres to the photoconductor drum 11. The cleaning failure can be used as an index for determining the carrier adhesion phenomenon. Here, with regard to the developability, images were formed as solid monochrome images painted out 100%, the transmission density value was obtained therefrom, and evaluated as ○ (Good) when the transmission density value was equal to or more than 1.0, Δ (Fair) when the transmission density value was equal to or more than 0.7 and less than 1.0,and × (Poor) when the transmission density value was less than 0.7. With regard to the cleanability, after performing the printing continuously on 1,000 print sheets of A4 size by using a print pattern with the B/W ratio of 4.0%, the surface of the photoconductor drum 11 after cleaning was visually observed, and evaluated as ○ (Good) when there was no recess or streak extending in the circumferential direction on the photoconductor drum 11 and the cleaning had been done excellently, Δ (Fair) when a slight cleaning failure was observed, and x (Poor) when a severe cleaning failure was observed.

With reference to FIG. 5, among the comparative examples 1 to 5, there is no comparative example that was evaluated as "good" in both the cleanability and the developability. Specifically, comparative examples 1, 2, 4 and 5 were evaluated as "good" in the developability, but had a cleaning failure, and comparative example 3 was evaluated as "poor" in the developability, although it did not have a cleaning failure. On the other hand, the examples 1 to 5 were evaluated as "good" in both the cleanability and the developability. As apparent from the table shown in FIG. 5, when both the cleanability and the developability are good, the lowermost value of the AC impedance Z1 is $1.4\times10^5\Omega$ (see examples 1, 2), and the uppermost value is $9.7\times10^5\Omega$ (see example 4). Similarly, when both the cleanability and the developability are good, the lowermost value of the surface roughness Ra of the resin coat layer 83 of the developing sleeve 63A is 0.057 μm, and the uppermost value is 0.280 μm. From these lowermost values and uppermost values, it is understood that the cleanability and the developability are fair or good when the AC impedance Z1 is in the range from $1.0\times10^5\Omega$ to $1.0\times10^6\Omega$ and the surface roughness Ra of the resin coat layer 83 is in the range from 0.057 μm to 0.280 μm. That is, with these values, the carrier adhesion phenomenon is difficult to occur and the developability is good. Furthermore, it is understood that the surface roughness Ra is preferably in the range from 0.142 μm to 0.280 μm since, in that case, both the cleanability and the developability are good. In particular, it is understood that, when the resin coat layer 83 is made of nylon resin, both the cleanability and the developability are good. This means that a predetermined combination (relationship) of the values of the AC impedance Z1 and the surface roughness Ra of the developing sleeve 63A is effective as an index for objectively evaluating both of the cleanability and the developability. As a result, by configuring the rotating sleeve 62A and the developing sleeve 63A such that the AC impedance Z1 and the surface roughness Ra of the developing sleeve 63A are respectively in the above-mentioned ranges, it is possible to realize the developing device 41 and the image forming apparatus 10 in which the carrier adhesion phenomenon is difficult to occur and the developability is good.

Figure 8B:
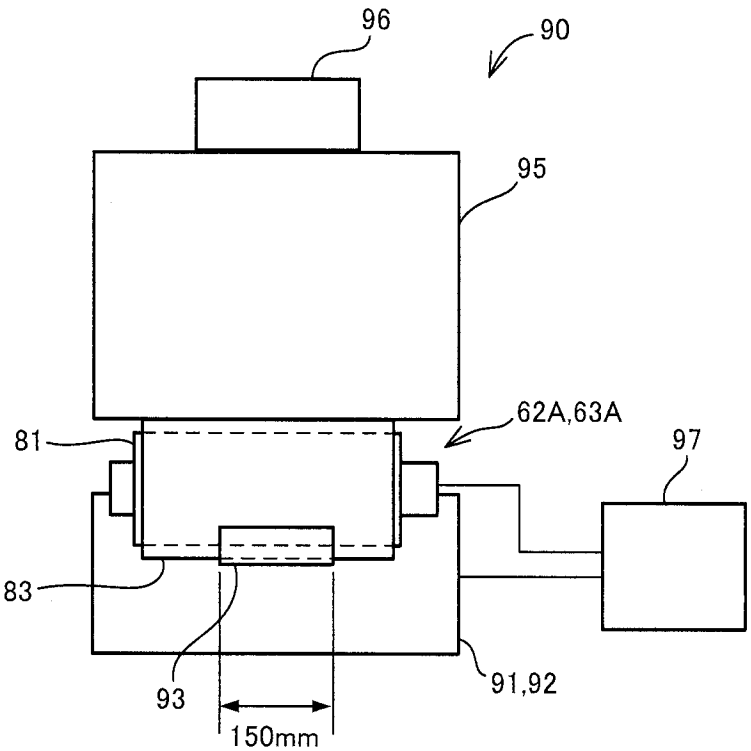
FIGS. 8A and 8B are schematic diagrams for explaining the measurement method of the AC impedances Z2, Z3.
Figure 8A:
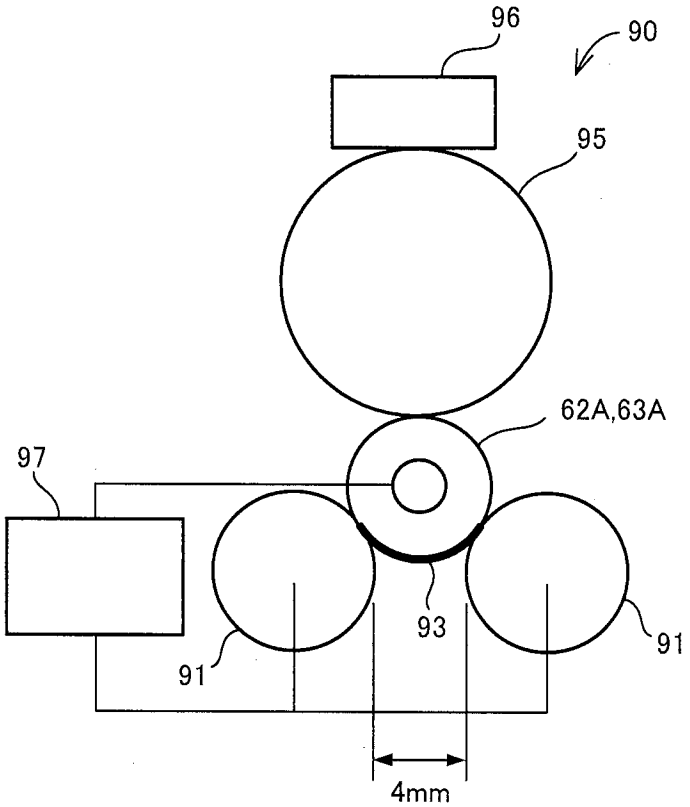

In the experiment 2, experiments 2-1 to 2-8 (see FIG. 6) were conducted in which the value of the AC impedance Z1 was varied by varying the amount of developer drawn up by the rotating sleeve 62A of the magnetic roller 62 used in the developing device 41 of the experiment 1. In these experiments, the AC impedance Z1 was obtained by a measurement method shown in FIG. 7. In the measurement method shown in FIG. 7, LCR HiTESTER 3522 made by Hioki E.E. Corporation was used as an impedance measuring instrument 97. An AC voltage of sine wave and 5.0 V at the frequency of 5.0 kHz was applied to between the rotating sleeve 62A and the developing sleeve 63A in the state where the magnetic brush was formed on the rotating sleeve 62A of the magnetic roller 62, and the AC impedance Z1 was measured by the impedance measuring instrument 97. In addition, an AC impedance Z2 of the rotating sleeve 62A and an AC impedance Z3 of the developing sleeve 63A were obtained by a measurement method using an experimental device 90 shown in FIG. 8. Here, FIG. 8 is a diagram showing the experimental device 90 for measuring the AC impedances Z2 and Z3 of the rotating sleeve 62A and the developing sleeve 63A, respectively. The experimental device 90 includes two SUS rollers 91, 92 which are made of stainless and each 18 mm in diameter and aligned in the horizontal direction with an interval of 4 mm therebetween. A film electrode 93 (150 mm long in the horizontal direction) made of aluminum is suspended between the SUS rollers 91 and 92. Either the rotating sleeve 62A or the developing sleeve 63A, as the target of the experiment, is disposed such that the roller surface thereof is closely contacted with the upper surface of the film electrode 93. Furthermore, a SUS roller 95 of 30 mm in diameter is disposed above the rotating sleeve 62A or the developing sleeve 63A. A load is applied to the SUS roller 95 by a weight 96 of 500 g, and the load is applied to the rotating sleeve 62A or the developing sleeve 63A via the SUS roller 95. It is noted that the roller bodies including the rotating sleeve 62A and the developing sleeve 63A are subjected to the experiment in the state where they are not rotated. The two SUS rollers 91, 92 are connected to an electrode of an impedance measuring instrument 97 (LCR HiTESTER 3522 made by Hioki E.E. Corporation), and the base body 85 of the rotating sleeve 62A or the base body 81 of the developing sleeve 63A is connected to the other electrode of the impedance measuring instrument 97. In this state, an AC voltage of sine wave and 5.0 V at the frequency of 5.0 kHz was applied to both ends of the impedance measuring instrument 97, and the AC impedance Z2 of the rotating sleeve 62A or the AC impedance Z3 of the developing sleeve 63A was measured. In this way, the AC impedances Z1, Z2 and Z3 were measured by the impedance measuring instrument 97. In the experiment 2, the measurement was performed a plurality of times (twice to 16 times), and the average values of the measured values are shown in the table of FIG. 6 as the experiment results. It is noted that in FIG. 6, the AC impedances Z2, Z3 are each indicated as a ratio to the AC impedance Z1.

An evaluation on the occurrence of leak was further made based on the results of an image formation in which a monochrome image was formed on a print sheet by using the developing device 41 that has the experiment result values shown in FIG. 6. Here, the leak is a leak between the rotating sleeve 62A and the developing sleeve 63A. The leak is a phenomenon where an overcurrent flows to the base body 85 of the rotating sleeve 62A, breaks the insulation of the alumite layer 86 of the rotating sleeve 62A, and flows to the developing sleeve 63A of the developing roller 63 via the magnetic brush. The leak is difficult to occur if the surface of each of the developing sleeve 63A and the rotating sleeve 62A has a high resistance. However, when the surface of either of them has a high resistance, the leak occurs in such a wide range as can be visually observed in the output image. The inventors further found, from the results of the experiments 2-1 to 2-8 (see FIG. 6), a relationship among the AC impedances Z1, Z2 and Z3 that corresponds to the difficulty for the leak to occur.

With regard to the occurrence of leak, after performing the printing continuously on 1,000 print sheets of A4 size by using a print pattern with the B/W ratio of 30%, the evaluation was made by visually observing all the images on the print sheets. With regard to the occurrence of leak, the image on the print sheet was visually observed, and evaluated as ○ (Good: leak did not occur) when no low-image-quality part affected by occurrence of leak was observed, and evaluated as x (Poor: leak occurred) when a low-image-quality part affected by occurrence of leak was observed.

From the results of the experiments 2-1 to 2-8 shown in FIG. 6, it is understood that the leak does not occur when a ratio Z2/Z1 and a ratio Z3/Z1 are each in the range from 0.25 to 0.4, the ratio Z2/Z1 being a ratio of the AC impedance Z2 to the AC impedance Z1, the ratio Z3/Z1 being a ratio of the AC impedance Z3 to the AC impedance Z1. This means that in the developing device 41 of the present embodiment, the ratios Z2/Z1 and Z3/Z1 are effective as an index for objectively evaluating the occurrence of leak. As a result, by configuring the developing device 41 such that the ratios Z2/Z1 are Z3/Z1 are each in the above-mentioned range, it is possible to realize the developing device 41 that prevents leak from occurring. That is, in the developing device 41 in which the ratios Z2/Z1 and Z3/Z1 are each in the above-mentioned range, the leak does not occur, the developability is good, and the magnetic carrier is difficult to adhere to the developing sleeve 63A.

It is noted that the above-described embodiment explains, as an example, the developing sleeve 63A that includes the alumite layer 82. However, the present disclosure is applicable to the developing sleeve 63A in which the resin coat layer 83 is directly formed on the base body 81, without forming the alumite layer 82 on the base body 81. It is also noted that the above-described embodiment explains, as an example, the developing sleeve 63A that includes the alumite layer 82 and the rotating sleeve 62A that includes the alumite layer 86. However, the present disclosure is applicable to the rotating sleeve 62A and the developing sleeve 63A that include, instead of the alumite layers 82 and 86, aluminum oxide thin films formed by a film formation treatment other than the alumite treatment.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developing roller disposed to face, without contact, an outer circumferential surface of an image carrier, and including an aluminum oxide thin film and a resin coat layer, the aluminum oxide thin film being formed on an outer circumferential surface of a base body that is made of a metal including aluminum, the resin coat layer being formed on a surface of the aluminum oxide thin film, the resin coat layer being made of a resin material having electric conductivity;

a magnetic roller disposed to face, without contact, an outer circumferential surface of the developing roller, and including an aluminum oxide thin film formed on an outer circumferential surface of a base body that is made of a metal including aluminum, the magnetic roller forming a toner layer on a surface of the developing roller via a magnetic brush composed of toner and magnetic carrier, wherein an AC impedance Z1 is in a range from $1.0\times10^5\Omega$ to $1.0\times10^6\Omega$ and a surface roughness Ra of the resin coat layer is in a range from 0.057 μm to 0.280 μm, the AC impedance Z1 being obtained when an AC voltage at a predetermined frequency is applied to between the base body of the magnetic roller and the base body of the developing roller in a state where the magnetic brush is formed on the magnetic roller, and a ratio Z2/Z1 and a ratio Z3/Z1 are each in a range from 0.25 to 0.4, the ratio Z2/Z1 being a ratio of an AC impedance Z2 to the AC impedance Z1, the ratio Z3/Z1 being a ratio of an AC impedance Z3 to the AC impedance Z1, the AC impedance Z2 being obtained when the AC voltage at the predetermined frequency is applied to between the base body of the magnetic roller and a surface of the magnetic roller, the AC impedance Z3 being obtained when the AC voltage at the predetermined frequency is applied to between the base body of the developing roller and the surface of the developing roller.

2. The developing device according to claim 1, wherein the resin coat layer is formed from nylon resin which contains titanium oxide in a dispersed state.

3. The developing device according to claim 1, wherein the AC voltage is a sine wave of 5 V, and the frequency thereof is 5.0 kHz.

4. An image forming apparatus comprising the developing device according to claim 1.

* * * * *